US010709267B2

(12) United States Patent
Kologe

(10) Patent No.: US 10,709,267 B2
(45) Date of Patent: Jul. 14, 2020

(54) DISPLAY BAR ASSEMBLY AND MOUNTING BRACKET FOR MERCHANDISING DISPLAYS

(71) Applicant: Joseph F. Kologe, Scranton, PA (US)

(72) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 16/130,567

(22) Filed: Sep. 13, 2018

(65) Prior Publication Data

US 2020/0085212 A1 Mar. 19, 2020

(51) Int. Cl.
*A47F 5/08* (2006.01)
*A47B 57/42* (2006.01)
*A47B 57/40* (2006.01)

(52) U.S. Cl.
CPC ..... *A47F 5/0838* (2013.01); *A47B 57/406* (2013.01); *A47B 57/42* (2013.01)

(58) Field of Classification Search
CPC ..... A47F 5/0838; A47B 57/42; A47B 57/406
USPC ..... 248/220.22, 243, 251, 254, 261, 262, 248/266, 558, 911, 220.21; 211/123, 124
See application file for complete search history.

(56) References Cited

U.S. PATENT DOCUMENTS 4,455,007 A * 6/1984 Varon ..... A47F 5/00 248/251
4,874,148 A * 10/1989 Guinter ..... A47B 57/42 248/220.22
5,395,081 A * 3/1995 Vollink ..... A47G 7/044 248/217.1
5,702,010 A * 12/1997 Liang ..... A47G 25/0685 211/105.1
7,404,533 B1 * 7/2008 Kologe ..... A47F 5/0838 248/220.22
7,438,268 B2 * 10/2008 Kologe ..... A47F 5/0838 248/220.22
8,210,367 B2 7/2012 Nagel et al.
2006/0021722 A1 * 2/2006 Nien ..... A47H 1/102 160/330
2008/0203040 A1 * 8/2008 Kologe ..... A47F 5/0838 211/103

* cited by examiner

*Primary Examiner* — Muhammad Ijaz
(74) *Attorney, Agent, or Firm* — St. Onge Steward Johnston & Reens, LLC

(57) ABSTRACT

An improved display bar assembly, for the cantilever support of product dispensing trays. A rectangular display bar, is supported by spaced apart, flat mounting brackets on which mounting hooks are located in the primary plane of the bracket, and openings for reception of the display bar are offset axially inward from that plane enabling the recessed accommodation of flanged retaining plugs at opposite ends of the bar. The flanges of the retaining plugs have axially extending abutment walls which overlap outer walls of the display bar and engage offset surfaces of the bracket. The abutment walls overlap display bar walls on two opposing sides only, enabling the retaining plugs to be molded with transverse friction fins. This in turn enables the use of readily available, inexpensive grades of light gauge (e.g., 16 gauge) steel tubing of greater height than width (e.g., 1×1.5 inch) for the display bars.

21 Claims, 6 Drawing Sheets

DISPLAY BAR ASSEMBLY AND MOUNTING BRACKET FOR MERCHANDISING DISPLAYS

FIELD OF THE INVENTION

The invention is in the field of merchandise displays and is more particularly directed to display bar assemblies for the cantilever mounting of trays for the display and dispensing merchandise.

BACKGROUND OF THE INVENTION

The display of merchandise in stores and supermarkets often involves the use of trays in which products are placed in columns and continuously urged to the front by spring-driven pushers. Such trays often are mounted in a cantilever fashion, by means of display bar assemblies carried by a store's merchandising structures, such as gondolas. An advantageous form of such trays, which are in widespread use, is illustrated in U.S. Pat. No. 8,210,367, owned by Trion Industries, Inc. An advantageous means for the mounting of such trays is shown in U.S. Pat. Nos. 7,404,533 and 7,438,268, also owned by Trion Industries. These patents disclose mounting bar assemblies in which square, tubular tray-mounting bars are provided at opposite ends with slidably movable mounting brackets. The brackets have mounting hooks that are engagable with slotted vertical uprights mounted on gondolas or other merchandising structures in the stores. The bar-mounting brackets are slidable to accommodate spacing variations between pairs of slotted uprights, and are captured on the bars by means of flanged retaining plugs inserted into opposite ends of the bars. While the systems of above-mentioned patents have been very successful, there has been currently increasing trend by merchandizers to display heavier merchandise. This can result in overloading of the standard cantilever-mounted trays and also the display bar assemblies for mounting them. There currently is a need for more robust display structures that can be made available to the trade without significant cost increase.

SUMMARY OF THE INVENTION

The invention is directed to improvements in several aspects of the existing display bar assemblies, rendering them more able to withstand higher load levels while at the same time minimizing increases in the cost thereof. One aspect of the invention involves improved design features in the brackets by which the tubular bars are mounted to the slotted vertical uprights. In the earlier designs of U.S. Pat. Nos. 7,404,533 and 7,438,268, the mounting brackets were configured such that mounting hooks, by which the brackets are engaged with the uprights, are laterally offset from the main parts of the brackets through which the tubular bar projects. The tubular bars have flanged retaining plugs at opposite ends, which prevent separation of the brackets from the bars, and the lateral offset of the mounting hooks is such that the exposed portions of the flanged retaining plugs do not project significantly beyond the mounting hooks. This enables two bars to be set at the same level in axial alignment in adjacent sets.

With increasingly heavier loading, however, the laterally offset bracket hooks became a weak point in the display. This is eliminated in accordance with the present invention by positioning the hooks within the plane of the main part of the bracket, and forming a narrow lateral offset completely surrounding the opening for the bar. The surrounding offset enables the flanged head of the retaining plug to be recessed from the primary plane of the bracket, serving the same purpose of the laterally offset hooks of the earlier design while avoiding structural weaknesses introduced by offsetting of the hooks. Additionally, the new design gives the mounting brackets a superior, cleaner looking appearance.

A further aspect of the invention is directed to the configuration of the tubular bar itself. An industry standard bar for the purpose has been a welded steel tube of one-inch square configuration, formed of 16 gauge steel. However, this has proved problematic with the heavier load requirements of some stores, and efforts have been made to utilize a heavier, stronger 13 gauge square steel tubing in place of the standard 16 gauge. However, the 13 gauge bar proved to be considerably more expensive. Moreover, and perhaps more importantly, dimensional specifications for the bar, in order to properly accommodate the flanged retaining plugs, were very tight and difficult for manufacturers to meet. Thus, the 13 gauge square bar proved to be not only very costly, but often difficult to obtain at any price because of the difficulties of achieving the necessarily tight tolerances. Pursuant to the invention, these problems were solved in part by reconfiguring the tubular bar from a one-inch square to a rectangular configuration of one inch in width and approximately 1 and ½ inches in height. Because the reconfigured bar provides better support for the cantilevered trays, it is feasible to utilize the lighter 16 gauge steel, even with heavier load requirements.

Yet another aspect of the invention involves an advantageous design of flanged retaining plug for the display bar, which enables it to perform its required functions while eliminating the need to tight tolerances in the dimensions of the tubing. The costs for the rectangular tubing can thus be kept consistent with the costs for the original square tubing while achieving superior performance.

In order to assure proper support for the ends of the tubular display bar in the brackets, it is important that the end extremities of the bar project through the openings in the brackets and for a short distance beyond. To this end the flanged plugs of existing design are formed of hard plastic material, with axially projecting abutment flange portions that overlap end portions of the exterior wall of the tubing at the corners for a short distance (e.g., 0.06 inch). When the mounting brackets engage these projecting abutment flanges they are blocked against further movement toward the ends of the tubing. Pursuant to another aspect of the invention, an improved form of flanged retaining plug is formed of a softer, more resilient plastic material, which is molded with a plurality of transversely disposed friction fins to engage the interior walls of the tubular display bar to secure the retaining plug in position. While plugs with such friction fins are in themselves known, the flanged retaining plug of the invention is formed with axially extending abutment wall portions only on two opposed sides of the flange, preferably the long sides. This enables mold parts for the molding of the plug to be withdrawn laterally, from opposite sides, to release the molded part. This novel configuration of the flange enables the friction fins to be formed by a molding process while also providing for the axially projecting abutment wall portions.

For a more complete understanding of the above and other features and advantages of the invention, reference should be made to the following detailed description of a preferred but non-limiting embodiment thereof and to the accompanying drawings.

DETAILED DESCRIPTION OF THE INVENTION

Figure 1:
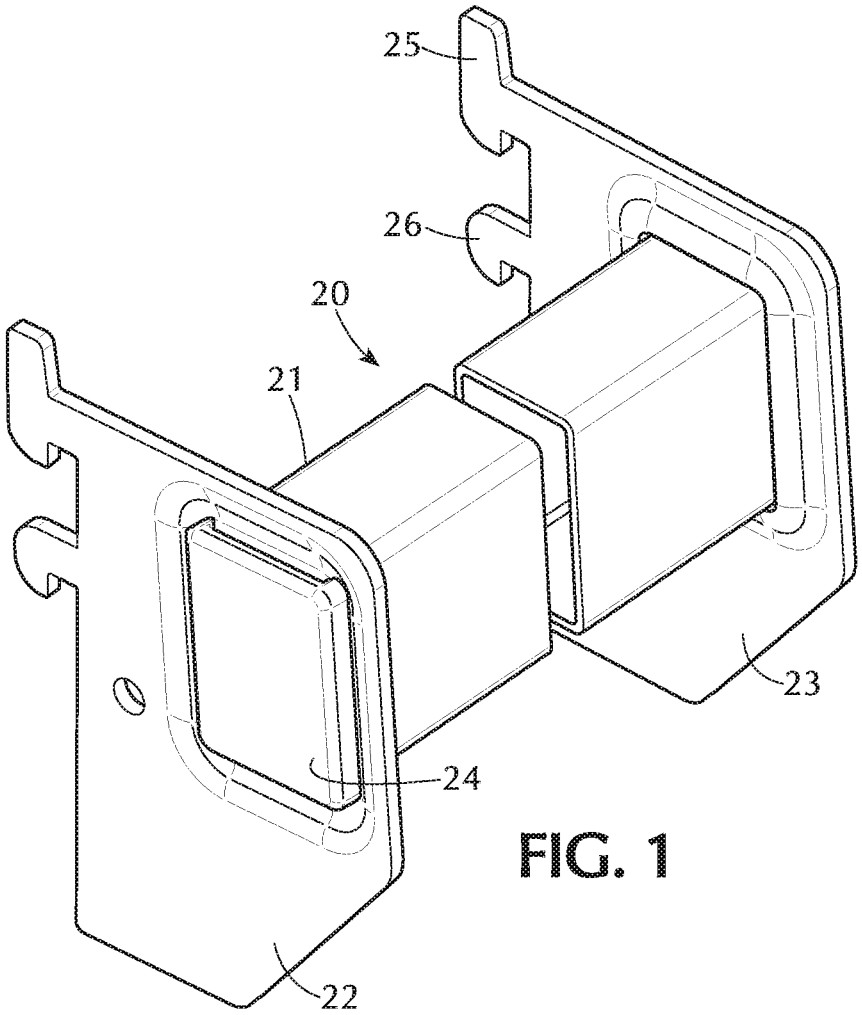
FIG. 1 is an orthographic view of a display bar assembly according to the invention.
Figure 3:
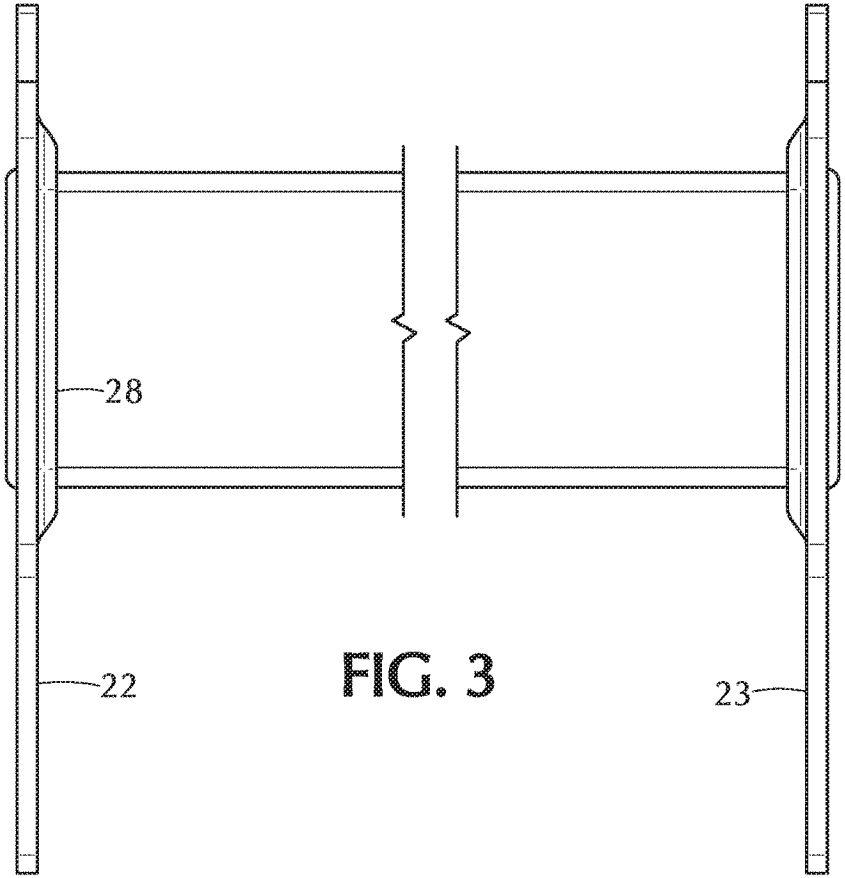
FIG. 3 is a front elevational view of the display bar assembly of FIG. 1.

Referring now to the drawings, and initially to FIG. 1 thereof, the reference numeral 20 designates a display bar assembly according to the invention. The assembly comprises a tubular bar 21 which is engaged at its opposite ends by mounting brackets 22, 23. The mounting brackets 22, 23 have openings 27 that closely confine but are slightly larger than the bar 21, such that the mounting brackets are axially slidable on the bar 21. This is provided to accommodate dimensional variations in the spacing of slotted vertical uprights (not shown) provided on the gondolas or other merchandise structures (not shown) provided by a store. Typically, such vertical uprights are spaced apart 48 inches to accept display bar assemblies 20 of 48 inches in length. One or both of the mounting brackets 22, 23 can be adjusted on the bar 21 in order to fit properly with the uprights. Flanged retaining plugs 24, to be described further, are inserted into opposite ends of the tubular bar 21 in order to prevent movement of the mounting brackets off of the ends of the bar.

Figure 2:
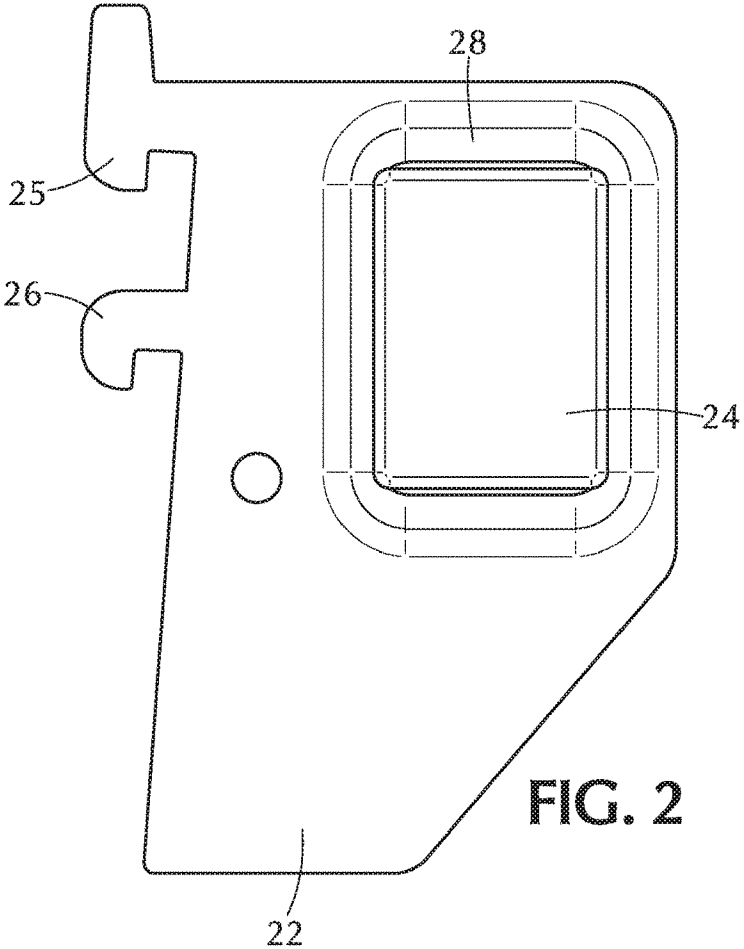
FIG. 2 is a side elevational view of the display bar assembly of FIG. 1.
Figure 6:
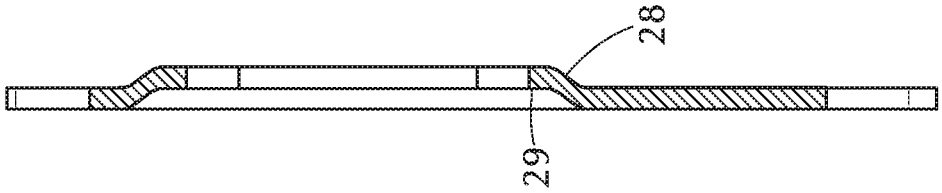
FIGS. 6 and 7 are cross sectional views of the bar-mounting bracket, as taken along lines 6-6 and 7-7, respectively, of FIG. 4, with FIG. 7 further showing an end portion of a display bar supported in the mounting bracket.
Figure 5:
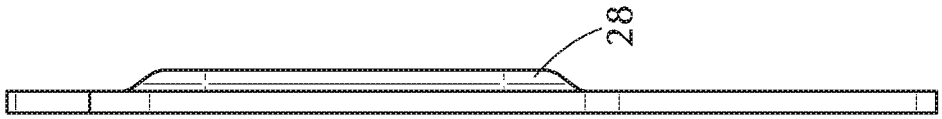
FIG. 5 is a front elevational view of the bracket of FIG. 4.
Figure 4:
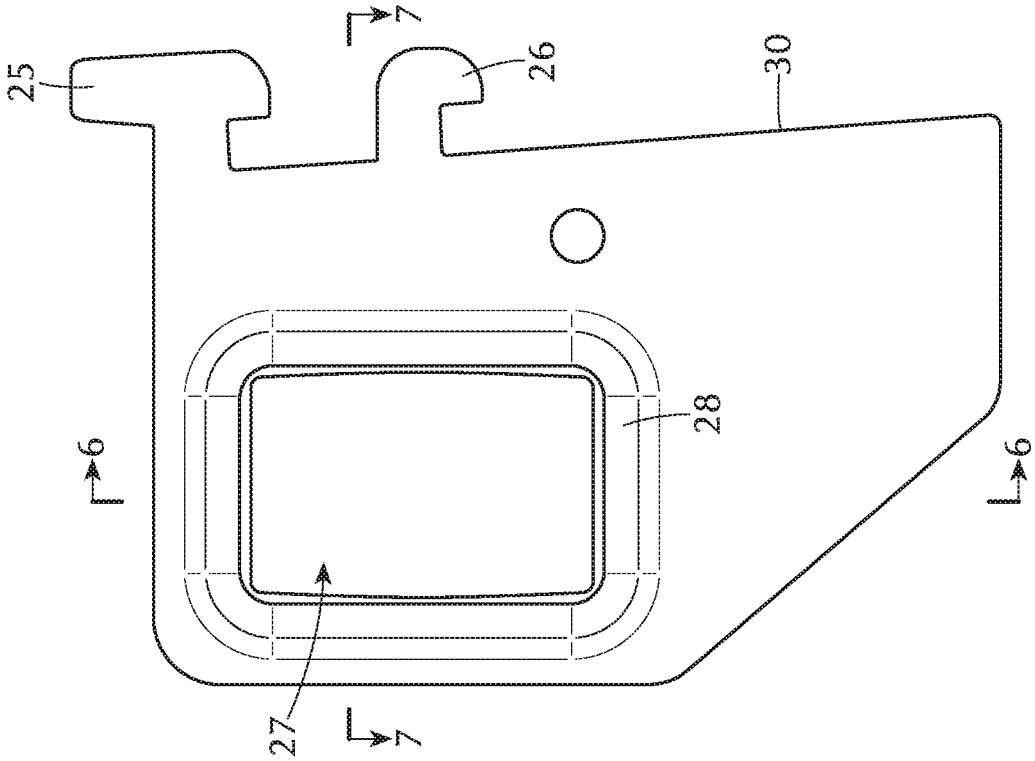
FIG. 4 is a side elevational view of a bar-mounting bracket incorporating advantageous new features according to the invention.
Figure 7:
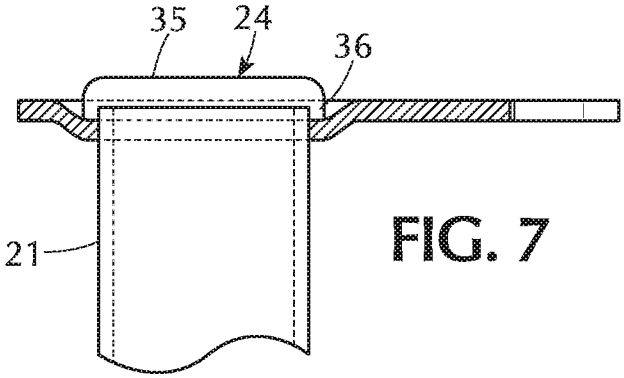
Figure 8:
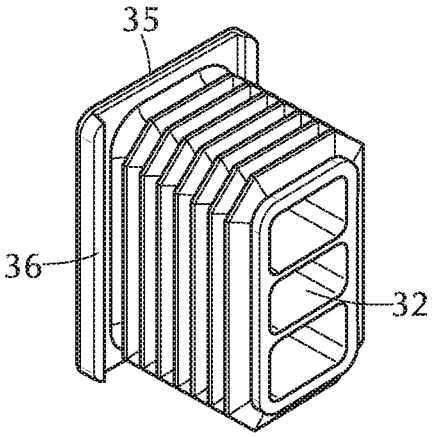
FIG. 8 is an orthographic view of a new form of flanged retaining plug according to the invention.

As shown in FIGS. 1, 2 and 4, the mounting brackets 22, 23 are formed with upright-engaging hooks 25, 26 configured to be received in appropriately dimensioned slots in the vertical uprights. Desirably, the upper hooks 25 have upward extensions that serve to prevent accidental dislodgment of the brackets from the uprights.

It is desired that the outer end surfaces of the flanged retaining plugs 24 be spaced apart no more than 48 inches, so that one display bar assembly, mounted on one set of uprights, will not interfere with an adjacent display bar assembly, mounted on an adjacent set of uprights. Accordingly, in known devices it has been customary to offset the mounting hooks from the principal plane of mounting brackets such that the flanged ends of the retaining plugs 24 are substantially aligned with the upright-engaging hooks. This can be seen in, for example, the before mentioned U.S. Pat. No. 7,404,533. While offsetting of the mounting hooks serves the purpose of properly locating the flanged ends of the plugs, it becomes an undesirable weak point in the bracket structure, when the assembly is required to carry heavier loads.

In accordance with an aspect of the invention, the undesired weakness in the bracket structure is avoided by maintaining the mounting hooks 25, 26 in the principal plane of the bracket 22, 23 and offsetting a narrow portion of the bracket in a region 28 immediately surrounding the opening 27. In a particularly preferred embodiment of the invention the bracket material is hard (Rockwell B 60-75) sheet steel of about 0.10 inch in thickness. The surrounding offset region 28, for a 1 inch by 1.5 inch opening may extend outward from the edges of the opening for about 0.32 inch, and the amount of the offset may equal the thickness of the bracket material of about 0.10 inch. The offset region 28 preferably is of sufficient width to provide a substantially flat margin 29 of at least about 0.05 inch in width immediately surrounding the opening 27. The surface of the flat margin 29 desirably forms a second plane parallel to the primary plane of the bracket and thus forms an outwardly facing recess. Except for the offset region 28, the sheet steel material of the brackets 22, 23, particularly including the mounting hooks 25, 26, is all in a common flat plane.

Preferably, the orientation of the bracket openings 27 is at a slight angle to the back edges 30 of the brackets, as reflected in FIG. 4. The display bars 21, which fit closely within the openings 27, are thus tilted slightly to the rear in their upper portions.

The above described design and configuration of the mounting brackets is not only structurally superior to the known brackets of the prior art but also benefits from having a neater, cleaner appearance which is more attractive to the stores and their customers.

In accordance with another aspect of the invention, the display bar 21, which has been in widespread use for many years in the form of a one inch square tubular steel bar, has been replaced by a tubular steel bar of one inch by one and one-half inch dimension oriented with the longer axis upright. Efforts to strengthen the standard 1 inch bar by increasing the thickness of material from the standard 16 gauge to a heavier 13 gauge, in order to withstand heavier loading desired by some stores, proved to be both difficult and unsatisfactory. Because of the practical requirement of having a minimum length of the tubing, at each end, project through and beyond the mounting brackets, the flanged retaining plugs need to be molded in a way to provide portions of the flange that extend for a distance axially inward over the exterior wall of the tubing and serve as abutments to limit axial movement of the mounting brackets in relation to end extremities of the display bar 21. The axially extending abutment portions of the flange assure that at least the desired length of tubing at each end projects outward of the bracket under all circumstances. However, with flanged retaining plugs of known design with it is necessary to hold relatively tight dimensional tolerances on both the tubing and the plugs to order to assure reliable retention of the plugs within the tubing. While this was feasible when using 16 gauge square tubing, it turned out to be a serious problem when seeking to add strength by using a heavier, 13 gauge tubing. Manufacturers found it very difficult to achieve the necessary tight tolerances with the 13 gauge material. It became very expensive at best and often difficult to obtain regardless of price. Accordingly, as a further aspect of the invention, both the tubing and the flanged plug were modified in a manner to bring the cost and availability factors back into line while at the same time providing a superior product.

By a significant redesign of both the flanged plug, and tubular display bar according to the invention, it has been possible to utilize a differently configured (1×1.5 inch) bar, and a different type of flanged plug. This in turn has made it possible to form the bar from 16 gauge steel with a strength equivalent for the purpose corresponding to that of a 13 gauge square bar. Moreover and importantly, because of the reconfigured flanged plug, to be described further, narrow tolerance requirements for the bar are not required, and it is possible to make use of commodity level ASTM tubing without sacrifice of functionality. Indeed, the cost, functionality and availability factors or the new display bar assembly are sufficiently favorable as to make it feasible to utilize the new, heavy duty design as a single standard support for trays with normal, lower weight loads as well as for trays with heavy weight load service.

For the 1×1.5 inch bar, the opening 27 in the brackets 23, 23 is configured to provide for a slight clearance at the top and sides with respect to the bar, such that the brackets 23, 23 may be moved axially along the bar as necessary to align with gondola uprights. Additionally, for the 16 gauge 1×1.5 inch tubing, it is desired to provide additional clearance in the center regions of the vertical sides. By way of example, acceptable clearance in the width direction, in the upper and lower portions of the opening 27 may range from about 0.019 inch to about 0.036 inch, while acceptable clearance in the vertical direction may range from about 0.036 inch to about 0.041 inch. In the center regions of the opening, an additional clearance of about 0.02 inch may be provided to accommodate a slight bulging of the bar 21.

Figure 13:
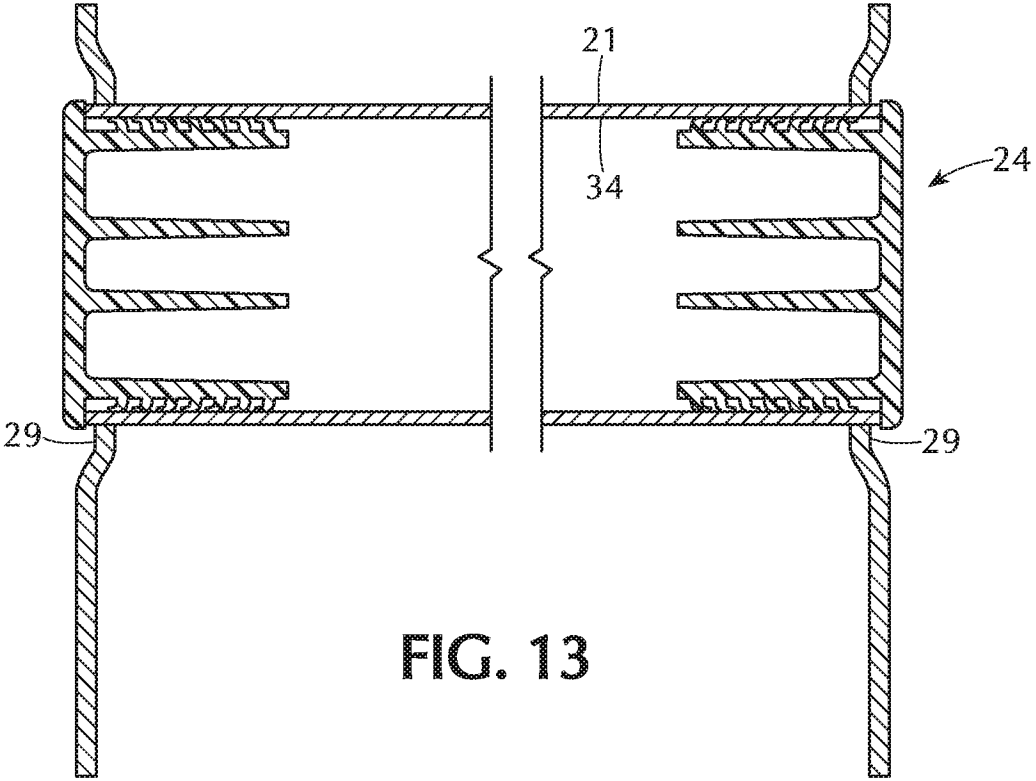
FIG. 13 is a cross sectional view of an end portion of the display bar with a retaining plug inserted therein, providing a minimum projection of the display bar through one of its mounting brackets.

Pursuant to another aspect of the invention, a new form of flanged plug 24 has been incorporated into the system, making it possible to utilize low cost tubing instead of costly and difficult-to-obtain high tolerance, "engineered" tubing needed to accommodate the requirements of known plugs. The new retaining plug, shown particularly in FIGS. 8-11 and 13, is formed of a semi-resilient material, advantageously a polyethylene having a Shore hardness of 45D-55D. The plug has an axially extending hollow body 31, with axially extending internal reinforcing ribs 32. The exterior side walls of the body 31 are provided with a plurality (preferably five to ten levels) of transverse, circumscribing friction fins 33 which are axially spaced apart along the length of the plug body 31. In the illustrated device, the friction fins 33, which are flat on their top surfaces and tapered on the their bottom surfaces, extend about 0.125 inch outward from the plug body and are dimensioned to provide an interference fit with the interior wall 34 of the display bar 21 (FIG. 13). In a preferred embodiment, the plug body 31 is dimensioned such that its outer side walls, in the absence of the friction fins 33, would be spaced about 0.075 inch from the inner walls 34 of the tubing. Accordingly, when the plugs 24 are inserted into the ends of the bar, there is approximately 0.050 inch of interference on each side, causing the fins to be resiliently displaced toward the flange 35 at the outer end of the plug, as reflected in FIG. 13.

Plugs with friction fins, as generally described above, are well known. The illustrated plug 24 of the invention, however is required to perform unique functions and is uniquely designed in order to be able to perform such functions. As mentioned above, it is critical that at least a small length of the display bar 21 project through and beyond the opening 27 in the mounting bracket 22, 23. Accordingly, the flange 35 is formed with axially extending abutment walls 36 (see FIG. 11) that closely overlap the exterior wall 37 of the display bar 21 on two opposing sides thereof and extend for a short distance (e.g. 0.06 inch) axially along the wall 37. The end surfaces of the abutment walls 36 form lateral projections and are configured to engage the mounting brackets 22, 23, in the recesses formed by the offset flat margins 29 thereof closely surrounding the openings 27, to prevent any further axially outward movement of the brackets relative to the bar 21. Thus, it is at all times assured that a minimum length of the display bar will project through the brackets.

Figure 9:
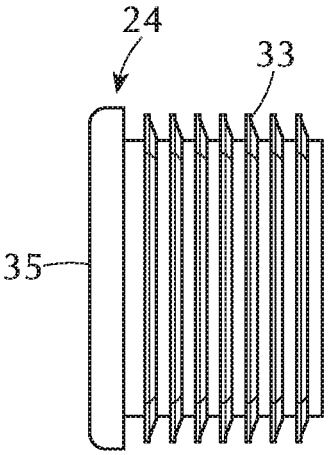
FIGS. 9, 10 and 11 are side, end and top views, respectively, of the flanged retaining plug of FIG. 8.
Figure 10:
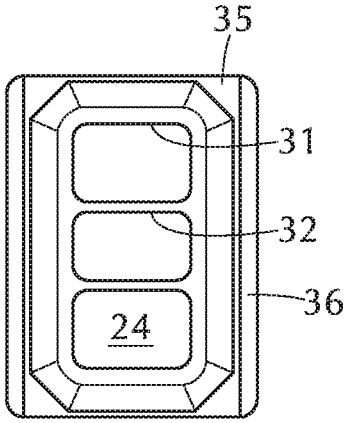
Figure 11:
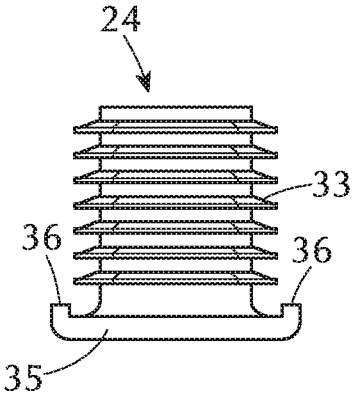
Figure 12:
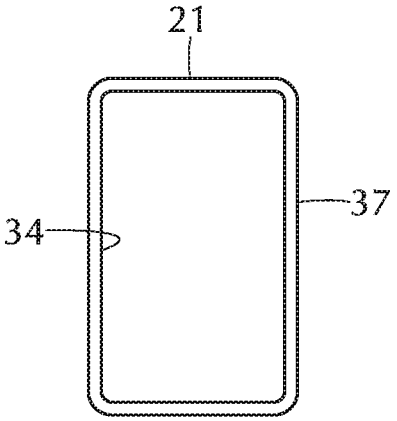
FIG. 12 is an end view of a display bar incorporated into the assembly of the invention showing the cross sectional configuration thereof.

As a unique feature of the plug 24, the abutment walls 36 are straight and are formed on only two opposing sides of the flange 35. This can be seen best in FIGS. 8 and 10. Preferably, but not necessarily the two sides are the long sides of the rectangular flange 35. By limiting the abutment walls 36 to two opposing sides, it is possible to construct the mold for the plug to have opposing parts that separate in the direction of the axes of the linear abutment walls 36. The mold parts thus can separate so as to be withdrawn linearly, parallel to the direction of the two sets of friction fins that project from the sides of the plug. With reference to FIGS. 9 and 10, for example, mold parts would be designed to retract vertically upward and downward to release the part after molding.

The unique flange configuration of the invention enables the display bar assembly to be constructed with a friction fin style of flanged plug at the end, and thus opens the assembly to the use of commodity level tubing. Such tubing is not only readily available from various sources, but is available at an attractive price. Thus while the initial design intent was to provide a special form of display bar assembly, capable of carrying loads that are heavier than those typically encountered, the cost and other advantages of the assembly of the invention are such as to make it an attractive alternative to use in connection with typical (i.e., lighter) loads, and thus suitable as "standard" for both normal and heavier loads.

It should be understood, or course, that the specific embodiments of the invention herein illustrated and described are intended to be representative of the invention and not in limitation thereof. Accordingly, reference must be made to the following claims in determining the full and proper scope of the invention.

What is claimed is:

1. A display bar assembly for mounting on a merchandising wall having pairs of horizontally spaced apart slotted uprights, the slotted uprights having vertically spaced apart vertical slots therein, said display bar assembly comprising:

a tubular display bar of rectangular cross section and of predetermined length, a first and a second mounting bracket for securing said tubular display bar to said spaced apart uprights, said first and second mounting brackets each having an opening for close-fitting but slidable, non-rotating reception of said tubular display bar, each said opening being sufficiently closed on all sides that said tubular display bar can be removed therefrom only by movement in a direction along a longitudinal axis of the tubular display bar, each of said first and second mounting brackets being formed of a section of a flat sheet metal defining a principal plane and having a back edge and an upper edge and having at least one downwardly opening hook, forming an integral part of said section of said sheet metal positioned in said principal plane, extending rearwardly from said back edge and positioned adjacent to said upper edge, each said sheet metal comprising a thickness to enable said hooks to be received in said vertical slots in said spaced apart uprights with the principal plane of said first and second mounting brackets being vertically oriented, a lateral projection positioned at each end extremity of said tubular display bar to prevent said first and second mounting brackets from being unintentionally removed from an end of said tubular display bar, each of said first and second mounting brackets having portions displaced axially inwardly from said principal plane, in a narrow region thereof immediately surrounding the opening therein, to form a recess surrounding said opening, such that the openings in said first and second mounting brackets are displaced axially inward with respect to said principal plane, whereby when one of said first and second mounting brackets is positioned at an outward limit position at an end extremity of said tubular display bar, the lateral projection positioned at said end extremity is at least partially received in said recess.

2. A display bar assembly according to claim 1, wherein said lateral projections comprise retaining plugs, formed of a resiliently displaceable material, inserted into opposite ends of said tubular display bar, each of said retaining plugs having an axially extending portion received within and gripping interior walls of said tubular display bar at opposite ends thereof, and flanges positioned at said end extremities of the tubular display bar, said flanges having portions extending laterally beyond outer walls of said tubular display bar and forming said lateral projections for engagement with outer surfaces of the recess in the respective first and second mounting brackets to prevent unintended removal of said first and second mounting brackets from said tubular display bar.

3. A display bar assembly according to claim 2, wherein the flanges of said retaining plugs include axially inwardly extending abutment portions overlapping with end margins of at least some of said outer walls of said tubular display bar whereby, when said abutment portions are in engagement with outer surfaces of said recesses of said first and second mounting brackets, end portions of said tubular display bar project axially outward from said recess outer surfaces.

4. A display bar assembly according to claim 1, wherein said inwardly displaced portions of said first and second mounting brackets are displaced by an amount corresponding to the thickness of said sheet metal.

5. A display bar assembly according to claim 1, wherein the rectangular cross section of said tubular display bar has a vertical dimension which approximately 50% greater than a horizontal dimension thereof, each said opening in said first and second mounting brackets have has a rectangular cross section, with vertical and horizontal dimensions slightly greater than the vertical and horizontal dimensions of the tubular display bar, providing a small clearance to accommodate free sliding movement of said first and second mounting brackets along said tubular display bar, and each said opening is formed with greater clearance in central portions of vertical sides thereof than at upper and lower end portions of said vertical sides.

6. A display bar assembly for mounting on a merchandising wall having pairs of horizontally spaced apart slotted uprights, the slotted uprights having vertically spaced apart vertical slots therein, said display bar assembly comprising:

a tubular display bar of rectangular cross section and of predetermined length, first and second mounting brackets for securing said tubular display bar to said spaced apart uprights, said first and second mounting brackets each having an opening for close-fitting but slidable, non-rotating reception of said tubular display bar, said opening being sufficiently closed on all sides that said tubular display bar can be removed therefrom only by movement in a direction along a longitudinal axis of the tubular display bar, each of said first and second mounting brackets being formed of a section of a flat sheet metal defining a principal plane and having a back edge and an upper edge and having at least one downwardly opening hook, forming an integral part of said section of said sheet metal positioned in said principal plane, extending rearwardly from said back edge and positioned adjacent to said upper edge, each said sheet metal comprising a thickness to enable said hooks to be received in said vertical slots in said spaced apart uprights with the principal plane of said mounting bracket being vertically oriented, a lateral projection positioned at each end extremity of said tubular display bar to prevent said first and second mounting brackets from being unintentionally removed from an end of said tubular display bar, each of said first and second mounting brackets having portions displaced axially inwardly from said principal plane, in a narrow region thereof immediately surrounding the opening therein, to form a recess surrounding said opening, such that the openings in said first and second mounting brackets are displaced axially inward with respect to said principal plane, whereby when one of said first and second mounting brackets is positioned at an outward limit position at an end extremity of said tubular display bar, the lateral projection positioned at said end extremity is at least partially received in said recess, said lateral projections comprising retaining plugs, formed of a resiliently displaceable material, inserted into opposite ends of said tubular display bar, said retaining plugs having axially projecting portions, received within and gripping interior walls of said tubular display bar at opposite ends thereof, and flanges positioned at said end extremities of the tubular display bar, said flanges having portions extending laterally beyond outer walls of said tubular display bar for engagement with outer surfaces of the recess in an associated mounting bracket to prevent unintended removal of said associated mounting bracket from said tubular display bar, the flanges of said retaining plugs including axially inwardly extending abutment portions overlapping with end margins of at least some of said outer walls of said tubular display bar whereby, when said abutment portions are in engagement with outer surfaces of said recesses of said first and second mounting brackets, end portions of said tubular display bar project axially outward from said recess outer surfaces, each of said retaining plugs, and the flanges thereof, being of generally rectangular configuration defining four side edges, said axially inwardly extending abutment portions of said flanges being formed on a first two opposing side edges of said flanges, and a second two opposing side edges of said flanges being formed without axially inwardly extending abutment portions.

7. A display bar assembly according to claim 6, wherein the rectangular cross section of said tubular display bar comprises two opposing vertical sides of a height greater than a width of two opposing horizontal sides thereof, and said retaining plugs, and the flanges thereof, have a rectangular configuration corresponding to the rectangular cross section of said tubular display bar, and said axially inwardly extending abutment portions are formed on vertical sides of said retaining plugs.

8. A display bar assembly according to claim 7, wherein said tubular display bar is approximately 1.5 inches in vertical height and approximately 1.0 inch in horizontal width.

9. A display bar assembly according to claim 7, wherein the axially projecting portions of said retaining plugs are formed with a plurality of levels of transversely disposed friction fins positioned to grip the interior side walls of said tubular display bar.

10. A display bar assembly according to claim 9, wherein said plugs are formed with five to ten levels of transversely disposed friction fins.

11. A display bar assembly according to claim 9, wherein said plugs are injection molded of polyethylene of a hardness-softness in a range of Shore durometer 45D to 55D.

12. A display bar assembly for mounting on a merchandising wall, said display bar assembly comprising:

a tubular display bar of rectangular cross section and of predetermined length, first and second mounting brackets for securing said tubular display bar to said merchandising wall, said first and second mounting brackets each having an opening for close-fitting but slidable, non-rotating reception of said tubular display bar, each said opening being sufficiently closed on all thereof sides that said tubular display bar can be removed therefrom only by movement in the direction of a longitudinal axis of the tubular display bar, a flanged retaining plug at each end extremity of said tubular display bar to prevent said first and second mounting brackets from being unintentionally removed from an end of said tubular display bar, each flanged retaining plug having a first part, received internally of said tubular display bar at an end thereof, and a second part forming a flange extending laterally over an end extremity of the tubular display bar and for a distance laterally beyond outer walls of at least two opposing sides of said tubular display bar to form a lateral projection, said flanged retaining plugs being molded of a plastic material having a Shore hardness-softness in a range of 45D-55D, said first parts of said plugs being formed with a plurality of axially spaced, transversely disposed and outwardly extending friction fins to grip interior walls of said tubular display bar, initial external dimensions of said friction fins being greater than internal dimensions of said tubular display bar, whereby said friction fins are resiliently displaced upon insertion of said plugs into said tubular display bar, said laterally extending flanges, on two opposed sides of said flanged retaining plugs, having abutment portions projecting axially inward from the end extremity of said tubular display bar and overlying outer surfaces of said two opposing sides of said tubular display bar to define a predetermined minimum distance that said end extremity projects axially beyond an outer surface of an adjacent one of said first and second mounting brackets, said flanges, on another two opposed sides of said flanged plugs, being formed without axially inwardly projecting outer portions.

13. A display bar assembly according to claim 12, wherein a vertical height of said tubular display bar is about 1.5 inch, and a horizontal width thereof is about 1.0 inch, and said axially inwardly projecting abutment portions of said plug flanges are disposed only along the vertical sides of said plug flanges.

14. A display bar assembly according to claim 13, wherein said axially projecting abutment portions of said plug flanges extend for an axial distance of about 0.06 inch to provide a minimum projection of the tubular display bar beyond the openings in said first and second mounting brackets.

15. A display bar assembly according to claim 12, wherein said friction fins project laterally from side walls of said plugs a distance of about 0.125 inch, and the overall lateral width dimensions of said friction fins is greater than internal dimensions of said tubular display bar by approximately 0.100 inch, providing for approximately 0.050 inch interference between said friction fins and internal walls of said tubular display bar on all sides thereof.

16. A display bar assembly according to claim 12, wherein the plastic material of which said flanged plugs are formed is polyethylene.

17. A pair of mounting brackets for mounting of a rectangular tubular display bar on a merchandising wall having pairs of horizontally spaced apart slotted uprights, the slotted uprights having a plurality of horizontally spaced apart pairs of vertically oriented slots therein, wherein:

each bracket of the pair comprises a flat section of sheet metal defining a principal plane and formed with a through opening therein of rectangular configuration for slidable, reception of the tubular display bar, each said bracket having a back edge and having a hook disposed in said principal plane and extending rearwardly from said back edge, for engagement with slots in said uprights to support said brackets with said principal planes thereof in a vertical orientation, said flat section of sheet metal being laterally deformed in a narrow region immediately surrounding said through opening, whereby said through opening, and the support provided thereby for said tubular display bar, is located in a second plane parallel to and offset laterally from said principal plane, the second plane of a first bracket of the pair of brackets being offset in a first direction and the second plane of a second bracket of the pair being offset in a second direction opposite to the first direction such that, when the pair of brackets is installed on said tubular display bar, said second planes are closer together than said principal planes.

18. A pair of mounting brackets according to claim 17, wherein the second plane of each bracket is offset from said principal plane of the bracket by an amount equal to a thickness of said sheet metal.

19. A pair of mounting brackets according to claim 17, wherein, said rectangular through opening of each bracket has a vertical dimension and a horizontal dimension, with said vertical dimension being greater than said horizontal dimension, and side edges of each said opening are spaced apart a greater distance in the center areas thereof than at the ends thereof.

20. A pair of mounting brackets according to claim 17, wherein said through opening of each mounting bracket is approximately 1.5 inches in height and 1.0 inch in width, the second plane of each mounting bracket is offset from said principal plane thereof by an amount equal to a thickness of said sheet metal, each said sheet metal has a thickness of about 0.10 inch, each said narrow region surrounding said respective opening has a width of about 0.032 inch.

21. A display bar assembly for mounting on a merchandising wall, said display bar assembly comprising:

a tubular display bar of rectangular cross section and of predetermined length, first and second mounting brackets for securing said tubular display bar to said merchandising wall, said first and second mounting brackets each having an opening for close-fitting but slidable, non-rotating reception of said tubular display bar, each said opening being sufficiently closed on all sides that said tubular display bar can be removed therefrom only by movement in a direction along a longitudinal axis of the tubular display bar, a flanged retaining plug at each end extremity of said tubular display bar to prevent said first and second mounting brackets from being unintentionally removed from an end of said tubular display bar, each flanged retaining plug having a first part, received internally of said tubular display bar at an end thereof, and a second part forming a flange extending laterally over an end extremity of the tubular display bar and for a distance laterally beyond outer walls of at least two opposing sides of said tubular display bar to form a lateral projection, said first part of each said plug being formed with a plurality of axially spaced, transversely disposed and outwardly extending friction fins to grip interior walls of said tubular display bar, initial external dimensions of said friction fins being greater than internal dimensions of said tubular display bar, whereby said friction fins are resiliently displaced upon insertion of said plug into said tubular display bar, said laterally extending flange, on two opposed sides of said flanged retaining plug, having abutment portions projecting axially inward from the end extremity of said tubular display bar and overlying outer surfaces of said two opposing sides of said tubular display bar to define a predetermined minimum distance that said end extremity projects axially beyond an outer surface of an adjacent one of said first and second mounting brackets, said flange, on another two opposed sides of said flanged plug, being formed without axially inwardly projecting outer portions.

* * * * *